United States Patent [19]

Kamino et al.

[11] 4,424,062

[45] Jan. 3, 1984

[54] PROCESS AND APPARATUS FOR CHEMICALLY REMOVING ASH FROM COAL

[75] Inventors: Yasumi Kamino; Shigenori Onitsuka; Takanobu Watanabe; Katsuyuki Yano, all of Osaka, Japan

[73] Assignee: Hitachi Shipbuilding & Engineering Co., Ltd., Osaka, Japan

[21] Appl. No.: 356,337

[22] Filed: Mar. 9, 1982

[30] Foreign Application Priority Data

| | | | |
|---|---|---|---|
| Mar. 13, 1981 | [JP] | Japan | 56-37117 |
| Mar. 30, 1981 | [JP] | Japan | 56-47662 |
| Apr. 15, 1981 | [JP] | Japan | 56-57426 |
| Apr. 15, 1981 | [JP] | Japan | 56-57427 |

[51] Int. Cl.[3] ..... C10L 9/02

[52] U.S. Cl. ..... 44/1 SR; 44/1 R; 423/461

[58] Field of Search ..... 44/1 R, 1 SR; 423/461

[56] References Cited

U.S. PATENT DOCUMENTS

| | | | |
|---|---|---|---|
| 2,808,369 | 10/1957 | Hickey | 423/461 |
| 4,071,328 | 1/1978 | Sinke | 44/1 SR |
| 4,305,726 | 12/1981 | Brown, Jr. | 44/1 SR |
| 4,328,002 | 5/1982 | Bender | 44/1 SR |

*Primary Examiner*—Delbert E. Gantz
*Assistant Examiner*—Anthony McFarlane

[57] ABSTRACT

Finely divided ash-containing coal is immersed in an aqueous solution of hydrochloric acid or citric acid, and acidic ammonium fluoride to cause the ash to react with the acid and the acidic ammonium fluoride, and the deashed coal is thereafter separated from the solution.

3 Claims, 10 Drawing Figures

PROCESS AND APPARATUS FOR CHEMICALLY REMOVING ASH FROM COAL

BACKGROUND OF THE INVENTION

The present invention relates to a process and an apparatus for chemically removing ash from coal.

Because of an uncertain oil supply perspective and increases in the oil price in recent years, the need to diversify the energy source has been recognized, with a worldwide trend toward reevaluation of coal. Methods of effectively utilizing coal are under investigation. Although coal has been used as a main energy source, coal, unlike petroleum, is solid and contains a large quantity of ash which is almost of no use and is therefore disadvantageous to use. Coal contains several percent to several ten percent of inorganic substances as an ash. Accordingly when coal is used as a fuel, such a large amount of ash is released. Coal further contains sulfur compounds which, when burnt, form sulfur oxides to cause air pollution. Coal, which is solid, has another problem in that it is cumbersome and expensive to handle for transport. To overcome these problems, extensive research has been conducted on processes for removing ash from coal. These processes are divided generally into physical processes and chemical processes. The physical processes include heavy fluid separation, floatation, magnetic separation and oil agglomeration processes, which are generally low in ash removing efficiency.

In the case of the chemical processes for removing ash from coal, the inorganic substances constituting the ash content of coal are reacted with chemical agents and separated from the coal for removal. Although varying from coal to coal, the composition of the ash content is generally as follows.

| Component | Proportion (wt. %) |
|---|---|
| $SiO_2$ | 40–60 |
| $Al_2O_3$ | 25–35 |
| $Fe_2O_3$ | 5–25 |
| CaO | 1–15 |
| MgO | 0.5–4 |
| $Na_2O$, $K_2O$, $SO_3$ | 1–4 |

The composition given above is that of the ash obtained after burning. Accordingly iron, for example, as contained in coal is generally in the form of $FeS_2$.

The conventional chemical processes for removing ash from coal include the following four processes.

(1) Dissolving with an acid.

(2) Dissolving with an alkali (at a high temperature with application of pressure).

(3) Oxidation with air, nitrogen dioxide or the like, followed by dissolving with an acid or alkali.

(4) Treatment with hydrofluoric acid or hydrogen fluoride gas.

Such processes are known as a process for removing ash from coal or coke (Japanese Patent Publication No. 466/1942), a process for removing sulfur and ash from coals (Japanese Patent Publication No. 23711/1971) and a coal deashing process (Japanese Patent Disclosure No. 133487/1980).

The processes (1) and (2) with use of an acid or alkali are practiced usually with the application of pressure and heat to dissolve the metallic components for the removal of ash. When practiced under moderate conditions, these processes are almost unable to achieve any ash removing effect and are therefore not suitable as deashing processes. The process (3) wherein oxidation is followed by an acid or alkali treatment is the same as the processes (1) and (2) in principle and is such that the $FeS_2$ components which are difficult to dissolve are first oxidized and thereafter dissolved. With the process (4) wherein hydrofluoric acid or hydrogen fluoride gas is used for treatment, coal is treated with hydrogen fluoride gas since $SiO_2$ is not easily soluble in acids or alkalis to separate Si in the form of gaseous $SiF_4$ to achieve a deashing effect. However, the use of hydrofluoric acid or hydrogen fluoride gas, which is highly toxic and corrosive, involves many difficulties.

Thus an actually effective and useful process for removing ash from coal still remains to be developed although the deashing of coal is a very important technique for the effective use of coal.

SUMMARY OF THE INVENTION

The object of the present invention is to overcome the foregoing problems and to provide a process and an apparatus for chemically removing ash from coal.

More specifically the invention provides a process for chemically removing ash from coal comprising the steps of immersing ash-containing finely divided coal in an aqueous solution of hydrochloric acid or citric acid, and acidic ammonium fluoride to react the ash with the acid and the acidic ammonium fluoride, and separating deashed fine coal particles from the aqueous solution.

The invention further provides an apparatus useful for the above process and comprising a deashing container including at least one fluidized liquid-solid mixture tank filled with the above deashing solution for removing ash from coal by dissolving, provided at its bottom with an inlet for supplying the deashing solution and adapted to receive a supply of finely divided coal in the vicinity of its bottom, a dewatering unit for separating the deashed coal from the deashing solution, a waste water treating unit for treating a portion of the deashing solution separated from the deashed coal, and a tank for preparing the deashing solution.

The invention further provides another apparatus useful for the above process and comprising a mixer for mixing crude coal with a deashing solution, a wet pulverizer for pulverizing the coal in the solution, a classifier for separating coarse coal particles from the resulting mixture, a dewatering unit for separating deashed fine coal particles from the deashing solution, a waste water treating unit for treating a portion of the deashing solution separated from the deashed fine coal particles, and a tank for preparing the deashing solution.

Coal can be deashed by the present process with an exceedingly higher efficiency than by the conventional processes. Moreover the operation can be carried out with very high safety. The overall treating process, which can be carried out in an aqueous solution under atmospheric pressure, is practical and very economical.

With the process of this invention, acidic ammonium fluoride is used conjointly with hydrochloric acid or citric acid. This ammonium compound is solid at room temperature, is therefore easy to handle, is easily soluble in water and produces little or no pressure in an aqueous solution due to hydrogen fluoride. Because it is an ammonium salt, the compound has the advantage that even if remaining in the deashed coal, it will not remain in the ash unlike other metallic salts when the coal is burnt.

Citric acid, when used for the present process, disappears upon burning because it is an organic acid. The acid therefore has the advantage that even if remaining in the deashed coal, the acid disappears when the coal is burnt, without any likelihood of remaining in the resulting ash.

The foregoing process can be carried out efficiently by the apparatus of the invention. Especially the first of the apparatus has the following advantages.

(1) Since pulverized crude coal and a deashing solution are agitated in a deashing container for forming a fluidized liquid-solid layer, there is no need to mechanically agitate them, and no power is needed for agitation. The deashing container, which is very simple in construction, can be easily protected from the corrosive solution, for example, with use of Teflon and is therefore economical.

(2) The container for continuously deashing coal selectively delivers fully deashed coal. The deashing solution prepared in the preparing tank is recycled to the deashing container, so that the solution can be maintained at a high concentration within the container, assuring a continuous ash removing treatment with a high efficiency.

(3) The use of the deashing solution in circulation reduces the amount of water to be used and also the amout of waste water to be treated, hence economical.

In the case of the second apparatus of the invention, crude coal is pulverized by the wet pulverizer and, at the same time, ash is removed with the deashing solution. This achieves an improved coal pulverizing efficiency and thoroughly mixes the pulverized coal with the solution in full contact with each other to attain a high ash removing efficiency. Because coal is thus pulverized and deashed at the same time, various means needed for deashing, the agitating power for the deashing reactor, etc. can be dispensed with, hence very economical.

The present invention will be described below in greater detail with reference to the accompanying drawings.

DESCRIPTION OF THE PREFERRED EMBODIMENTS

Figure 1:
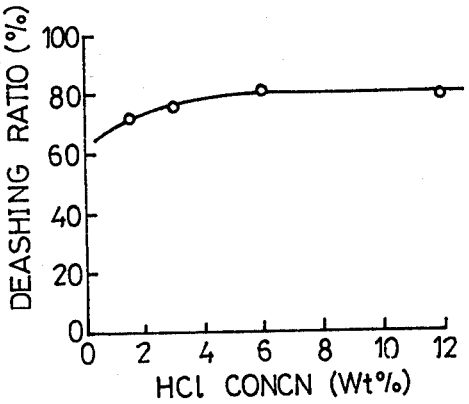
FIGS. 1 to 8 are diagrams showing the deashing ratios achieved by the process of this invention in experimental examples.

The process of this invention for chemically removing ash from coal comprises the steps of finely dividing ash-containing coal, immersing the finely divided coal in an aqueous solution of an acid, such as hydrochloric acid or citric acid, and acidic ammonium fluoride to cause the ash to react with the acid and the acidic ammonium fluoride, and thereafter separating deashed fine coal particles. The ash-containing coal may be finely divided first and then immersed in the deashing solution, or may be finely divided in the deashing solution.

In the above process, the ash-containing coal is finely divided into particles of not larger than 35 mesh (i.e. up to 500 $\mu$m) in mean size, preferably not larger than 100 mesh (i.e. up to 149 $\mu$m) in mean size. As will be easily understood, the coal is finely divided to give the coal an increased area of contact with the solution, to expedite dissolving and to permit the solution to penetrate into the interior of coal particles with a relatively increased efficiency. However, it is not necessary to pulverize the coal into extremely fine particles; insofar as the coal is finely divided to sizes not larger than the above limit, the deashing efficiency achieved will not vary greatly.

When hydrochloric acid is used as the acid, the treating solution contains 1.0 to 12.0% by weight, preferably 3.0 to 12.0% by weight, of hydrochloric acid and 1.25 to 10.0% by weight, preferably 2.5 to 10.0% by weight, of acidic ammonium fluoride ($NH_4HF_2$). A sufficient deashing ratio will not be achieved when the amount of hydrochloric acid is less than 1.0% by weight or when the amount of acidic ammonium fluoride is less than 1.25% by weight. Further when the amount of hydrochloric acid is at least 4.0% by weight and the amount of acidic ammonium fluoride is at least 5.0% by weight, an approximately definite deashing ratio is achieved, so that in view of economy and the treatment of the resulting effluent, it is desirable to use up to 10.0% by weight of hydrochloric acid.

When citric acid is used as the acid, the treating solution contains 1.0 to 10.0% by weight, preferably 2.0 to 10.0% by weight, of citric acid and 1.0 to 10.0% by weight, preferably 2.0 to 10.0% by weight, of acidic ammonium fluoride ($NH_4HF_2$). A sufficient deashing ratio will not be achieved if the amount of citric acid is less than 1.0% by weight, or if the amount of acidic ammonium fluoride is less than 1.0% by weight. Further when the amount of citric acid is at least 4.0% by weight and the amount of acidic ammonium fluoride is at least 5.0% by weight, an approximately constant deashing ratio is attained, so that in view of economy and the treatment of the resulting effluent, it is desirable to use up to 10.0% of citric acid. Since acidic ammonium fluoride reacts with $SiO_2$, $FeO_3$, $Al_2O_3$ and like metallic compounds and further with sulfur to form soluble salts, it is necessary to vary the amount of the fluoride in accordance with the ash content of the coal to be treated.

Because coal is deashed by a chemical reaction in the above process, the reaction temperature naturally influences the velocity of deashing. While the deashing ratio increases with the reaction temperature when the deashing treatment is conducted for a given period of time, we have found that the deashing reaction proceeds also at room or ambient temperature (about 25° C.), achieving a practically significant deashing ratio when the treatment is conducted for a prolonged period of time. The reaction time is dependent also on the concentrations of citric acid and acidic ammonium fluoride in the solution but especially on the reaction temperature. For example, at a temperature of 80° C., the reaction achieves approximately the highest deashing ratio in 2 to 3 hours. At a lower temperature, the reaction requires a longer period of time.

The invention will be described with reference to the following examples and comparison examples.

EXAMPLE 1

Blocks of Daido coal were pulverized and screened with a 100-mesh sieve (opening size: 149 $\mu$m) to obtain minus 100 mesh finely divided coal, which was used as a coal specimen. The ash content of the specimen was 10.3% based on dry weight. The ash content was determined by the following method (JIS M8815).

A suitable quantity of coal specimen was placed into a porcelain crucible weighing W0 g and dried in a dryer at 105±5° C. for 2 hours. The crucible was then weighed (W1 g). Next, the crucible was placed into an electric oven and heated from room temperature to 500° C. over a period of 1 hour and further to 815° C. over a period of 1 hour. The specimen was completely ashed while being stirred occasionally. The crucible was thereafter cooled and weighed (W2 g). The ash content based on the dry weight is calculated from the following equation.

$$\text{Ash content} = \frac{W2 - W0}{W1 - W0} \times 100\ (\%)$$

The specimen was deashed in the following manner. A 200 ml quantity of aqueous solution containing specified amounts of hydrochloric acid and acidic ammonium fluoride was placed into a Teflon beaker, and 20 g of the specimen was suspended in the solution. The mixture was treated at a specified temperature for a predetermined period of time while being agitated by a magnetic stirrer equipped with a heater. After the reaction of the ash, the coal was filtered off and washed with water repeatedly until the pH of the washing water reached 7 as determined by pH test paper. The ash content of the deashed coal was measured in the same manner as above, and the deashing ratio was calculated from the following equation.

$$\text{Deashing ratio} = \frac{A - B}{A} \times 100\ (\%)$$

wherein A is the ash content (%) of the specimen, and B is the ash content (%) of the deashed coal.

Table I below shows the results of the deashing treatment.

TABLE I

| Exp. No. | HCl concn. (%) | $NH_4HF_2$ concn. (%) | Temp. (°C.) | Time (h) | Deashing ratio (%) |
|---|---|---|---|---|---|
| 1 | 12.0 | 2.5 | 80 | 3 | 78.3 |
| 2 | 6.0 | " | " | " | 81.4 |
| 3 | 3.0 | " | " | " | 74.9 |
| 4 | 1.5 | " | " | " | 70.5 |
| 5 | 6.0 | 10.0 | " | " | 88.6 |
| 6 | " | 5.0 | " | " | 91.8 |
| 7 | " | 1.25 | " | " | 64.0 |
| 8 | " | 2.5 | 50 | " | 71.8 |
| 9 | " | " | 30 | " | 63.0 |
| 10 | " | " | 80 | 5 | 80.2 |
| 11 | " | " | " | 1 | 70.2 |

With reference to Table I, the concentration of hydrochloric acid was varied in the first series of experiments (No. 1 to No. 4). The concentration of acidic ammonium fluoride was varied in the second series of experiments (No. 5 to No. 7). The treating temperature was varied in the third series of experiments (No. 8 and No. 9). The treating temperature and time were varied in the fourth series of experiments (No. 10 and No. 11).

The first series shows that the conjoint use of acidic ammonium fluoride and hydrochloric acid achieves increased deashing ratios which are useful for practical purposes. However, the deashing ratio is somewhat dependent also on the hydrochloric acid concentration; the deashing ratio is lower at an acid concentration of 1.5% than at higher concentrations. FIG. 1 shows these results. It is seen that the deashing ratio almost levels off at about 80% when the concentration of hydrochloric acid is 4.5% and higher.

Figure 2:
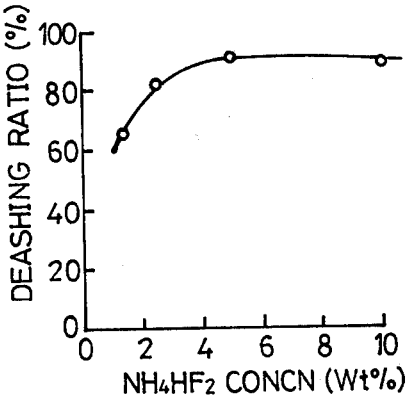

The second series reveals that the solution containing both hydrochloric acid and acidic ammonium fluoride attains an outstanding deashing ratio. The results are illustrated in FIG. 2, which also shows the result of Experiment No. 2 involving the same conditions. As will be apparent from FIG. 2, the concentration of acidic ammonium fluoride produces a relatively great influence, and the highest deashing ratio of about 90% is achieved at a concentration of about 4%.

Figure 3:
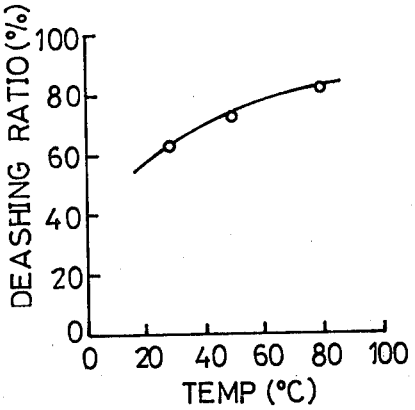

FIG. 3 shows the results of the third series along with the result of Experiment No. 2 conducted under the same conditions (except the temperature). The graph indicates that the temperature produces a relatively great influence and that the deashing ratio increases with the rise of the temperature. The deashing ratio of 63% afforded at 30° C. close to room temperature shows the outstanding deashing effect produced by the aqueous solution containing both hydrochloric acid and acidic ammonium fluoride.

Figure 4:
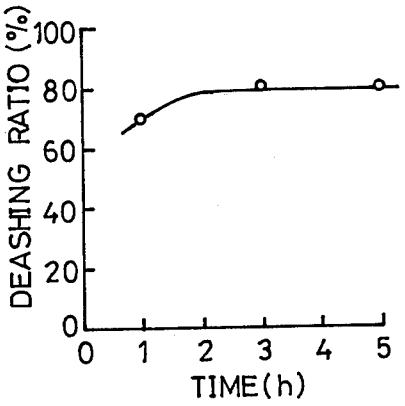

The graph of FIG. 4 shows the results of the fourth series and the result of Experiment No. 2 involving the same conditions (except the treating time). The graph indicates that under the conditions concerned, the deashing ratio levels off at 80% when the treatment is conducted for 2 hours.

EXAMPLE 2

Daido coal was pulverized by a superfine pulverizer to prepare a coal speciment (No. 12) of superfine particles 3.16 μm in mean size. The specimen had an ash content of 11.7%. On the other hand, blocks of the same coal were pulverized to 28 mesh to 48 mesh (mean particle size: 444 μm) to obtain a coal specimen (No. 13). This specimen had an ash content of 10.5%. The two specimens were deashed under the following conditions, and the deashing ratios were measured.

| | |
|---|---|
| Amount of specimen: | 20 g |
| Amount of treating solution: | 200 ml |
| Treating temperature: | 80° C. |
| Treating time: | 3 hours |
| Composition of solution: | Aqueous solution containing 6% of hydrochloric acid and 2.5% of acidic ammonium fluoride |

Consequently the specimen of superfine coal particles (No. 12) was deashed to a ratio of 75.5%, while the specimen of relatively large coal particles (No. 13) was deashed to 64.5%. Thus since the result achieved with the specimen No. 12 is nearly similar to those achieved in Example 1 above, it will be understood that coal need not be pulverized too finely. However, the deashing ratio is low in the case of the specimen of large particle size (No. 13). While it is difficult to determine the size to which coal is to be pulverized for the deashing treatment also in view of other deashing conditions, it is generally preferable to pulverize coal to sizes not larger than about 100 mesh.

EXAMPLE 3

Takashima coal was pulverized and screened to obtain a coal specimen (No. 14) of 70 to 200 mesh particles (mean size: 142 μm). The specimen had an ash content of 9.53%. The specimen was treated under the same conditions as in Example 2, whereby a deashing ratio of 76.7% was achieved. Thus coals of different kinds can be deashed by the process of the invention with high efficiencies.

EXAMPLE 4

The same Daido coal as used in Example 1 was deashed in the same manner as in Example 1 except that the treating solutions used were aqueous solutions containing citric acid and acidic ammonium fluoride in the proportions listed below. The results are shown in Table II below.

TABLE II

| Exp. No. | Citric acid concn. (%) | $NH_4HF_2$ concn. (%) | Temp. (°C.) | Time (h) | Deashing ratio (%) |
|---|---|---|---|---|---|
| 15 | 1.0 | 2.5 | 80 | 3 | 64.7 |
| 16 | 3.0 | " | " | " | 78.0 |
| 17 | 5.0 | " | " | " | 80.0 |
| 18 | 10.0 | " | " | " | 81.0 |
| 19 | 3.0 | 1.25 | " | " | 75.0 |
| 20 | " | 5.0 | " | " | 82.6 |
| 21 | " | 1.25 | " | " | 87.6 |
| 22 | " | 2.5 | 50 | 5 | 67.8 |
| 23 | " | " | 80 | " | 74.8 |

With reference to Table II, the concentration of citric acid was varied in the first series of experiments (No. 15 to No. 18). The concentration of acidic ammonium fluoride was varied in the second series of experiments (No. 19 to No. 21). The treating temperature and time were varied in the third series of experiments (No. 22 and No. 23).

Figure 5:
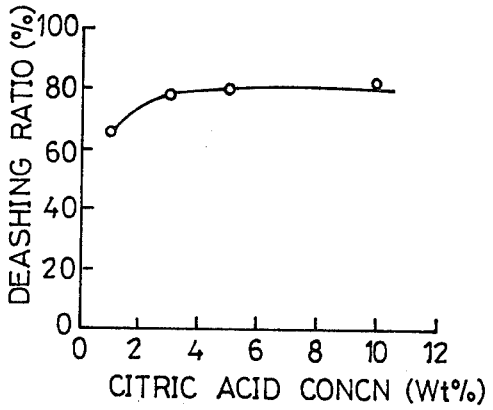

The first series shows that the conjoint use of acidic ammonium fluoride and citric acid achieves increased deashing ratios which are useful for practical purposes. However, the deashing ratio is somewhat dependent also on the citric acid concentration; the deashing ratio is lower at an acid concentration of 1.0% than at higher concentrations. FIG. 5 shows these results. It is seen that the deashing ratio almost levels off at about 80% when the concentration of citric acid is 5.0% and higher.

Figure 6:
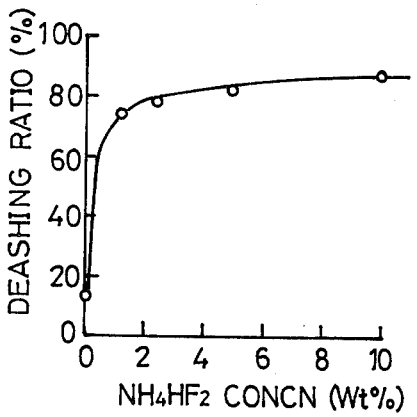

The second series reveals that the solution containing both citric and acidic ammonium fluoride attains an outstanding deashing ratio. The results are illustrated in FIG. 6, which also shows the result of Experiment No. 16 involving the same conditions. As will be apparent from FIG. 6, the concentration of acidic ammmonium fluoride produces a relatively great influence, and the highest deashing ratio of 75% is achieved at a concentration of about 1.25%.

Figure 7:
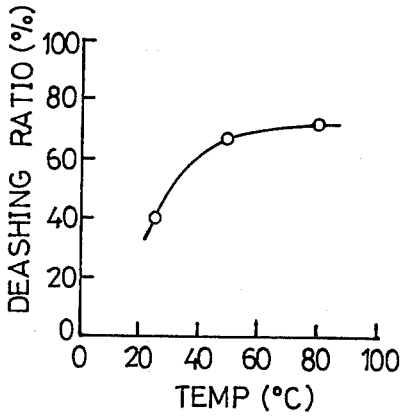
Figure 8:
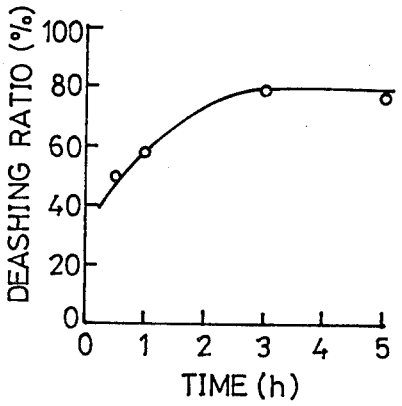

FIGS. 7 and 8 show the results of the experiments wherein the temperature and time were both varied. FIG. 7 shows that the temperature produces a relatively great influence and that the deashing ratio increases with the rise of the temperature. FIG. 8 shows that the deashing ratio levels off at 80% in about 3 hours.

EXAMPLE 5

Daido coal was pulverized by a superfine pulverizer to prepare a coal specimen (No. 24) of superfine particles 3.16 μm in mean size. The specimen had an ash content of 11.7%. On the other hand, blocks of the same coal were pulverized to 28 mesh to 48 mesh (mean particle size: 444 μm) to obtain a coal specimen (No. 25). This specimen had an ash content of 10.5%. The two specimens were deashed under the following conditions, and the deashing ratios were measured.

| | |
|---|---|
| Amount of specimen: | 20 g |
| Amount of treating solution: | 200 ml |
| Treating temperature: | 80° C. |
| Treating time: | 3 hours |
| Composition of solution: | Aqueous solution containing 3% of citric acid and 2.5% of acidic ammonium fluoride |

Consequently the specimen of superfine coal particles (No. 24) was deashed to a ratio of 67.6%, while the specimen of relatively large coal particles (No. 25) was deashed to 54.3%. Thus since the result achieved with the specimen No. 24 is nearly similar to those attained in Example 4 above, it will be understood that coal need not be pulverized too finely. However, the deashing ratio is low in the case of the specimen of large particle size (No. 25). While it is difficult to determine the size to which coal is to be pulverized for the deashing treatment also in view of other deashing conditions, it is generally preferable to pulverize coal to sizes not larger than about 100 mesh.

EXAMPLE 6

Liddell coal of Australia was pulverized and screened to obtain a coal specimen (No. 26) of 70 to 200 mesh particles (mean size: 142 μm). The specimen had an ash content of 8.28%. A 13 g quantity of the specimen was treated under the same conditions as in Example 5, whereby a deashing ratio of 70.9% was achieved. Thus coals of different kinds can be deashed by the process of the invention with high efficiencies.

COMPARISON EXAMPLE 1

For comparison, the same coal specimen as used in Example 1 was deashed with water and various acid or alkali aqueous solutions. Table III below shows the results obtained. The teating liquids were used all in a constant amount of 200 ml.

TABLE III

| Treating liquid | Amount of coal (g) | Temp. (°C.) | Time (h) | Deashing ratio (%) |
|---|---|---|---|---|
| Water | 26 | 25 | 1 | 10.1 |
| 6% Hydrochloric acid | 20 | Boil | 1 | 29.9 |
| 18% Hydrochloric acid | 25 | 50 | 3 | 26.5 |
| 16% Sulfuric acid | 25 | 50 | 3 | 27.8 |
| 38% Nitric acid | 25 | 50 | 3 | 26.7 |
| 10% Phosphoric acid | 25 | 50 | 3 | 15.4 |
| 24% Caustic soda | 25 | 50 | 3 | 9.5 |
| 3% Citric acid | 20 | 80 | 3 | 12.4 |

As will be apparent from Table III above, the coal, when washed with water, is deashed to some extent. However, the treatment with various aqueous acid solutions attained deashing ratios of as low as about 20 to about 30% although the solutions have considerably high concentrations. The treatment with the aqueous solution of caustic soda is also low in deashing ratio. The treatment with the 3% citric acid solution, like washing with water, fails to produce a substantial deashing effect.

COMPARISON EXAMPLE 2

For comparison, the same specimen as used in Example 1 was deashed with aqueous solutions of various fluorine compounds under the following conditions.

| | |
|---|---|
| Amount of specimen: | 20 g |
| Amount of treating solution: | 200 ml |
| Treating temperature: | 80° C. |
| Treating time: | 3 hours |

Table IV below shows the results.

TABLE IV

| Treating solution | Deashing ratio (%) |
|---|---|
| 2.5% Potassium fluoride | 13.3 |
| 2.5% Sodium fluoride | 10.5 |
| 2.5% Acidic potassium fluoride | 47.6 |
| 2.5% Ammonium fluoride | 11.3 |
| 2.5% Acidic ammonium fluoride | 61.0 |

Table IV reveals that the aqueous solutions of acidic potassium fluoride and acidic potassium fluoride achieved deashing ratios of about 50 to about 60%. This is presumably attributable to the influence of the hydrogen ion concentrations (pH values) of these solutions. It appears that the dissolving action of acids plays an important role in deashing coal although the deashing mechanism still remains to be clarified.

Although hydrofluoric acid and hydrogen fluoride are highly reactive with silica and can expectedly be effective as deashing agents, these compounds are very difficult to handle because they are strongly toxic and corrosive and also because hydrogen fluoride is gaseous.

COMPARISON EXAMPLE 3

A specified quantity of citric acid was added to the same aqueous solutions of fluorine compounds as used in Comparison Example 2, and a coal specimen was deashed by the conjoint use of the fluorine compound and citric acid under the same conditions as in Comparison Example 2. Table V below shows the results.

TABLE V

| Treating solution | Deashing ratio (%) |
|---|---|
| 2.5% Potassium fluoride - 3% citric acid | 45.0 |
| 2.5% Sodium fluoride - 3% citric acid | 48.5 |
| 2.5% Ammonium fluoride - 3% citric acid | 53.2 |
| 2.5% Acidic potassium fluoride - 3% citric acid | 64.2 |

Table V reveals that the solution containing both acidic potassium fluoride and citric acid achieved a considerably high deashing ratio which is comparable to that attained by the aqueous solution of acidic ammonium fluoride in Comparison Example 2.

Apparatus of this invention will now be described with reference to FIGS. 9 and 10.

Figure 9:
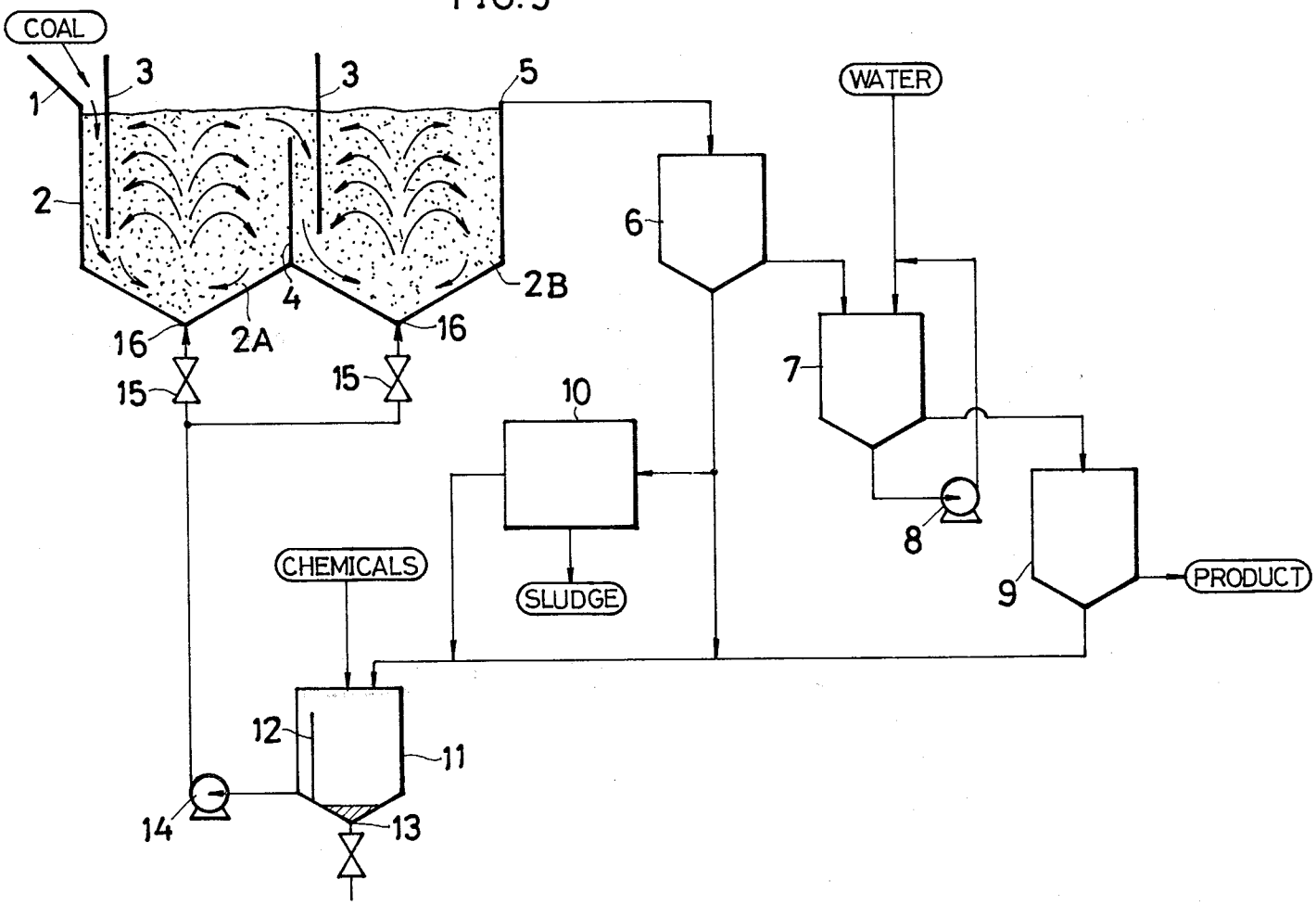
FIG. 9 is a flow chart showing an apparatus of this invention for chemically removing ash from coal.

Referring to FIG. 9, ash-containing crude coal, preferably finely divided coal not larger than 100 mesh in particle size, is continuously charged into a deashing container 2 through a coal inlet 1. Examples of useful finely divided coals are dry-pulverized coal, wet-pulverized coal and pulverized coal in the form of an aqueous slurry. The deashing container 2 is filled with a deashing solution and has partition plates 3 and inlets 16 for the solution to form a fluidized liquid-solid layer. The deashing solution is prepared by adding a fluoride to an aqueous solution of hydrochloric acid or citric acid containing a corrosion inhibitor. The inhibitor serves to protect the apparatus and piping from the corrosive solution of hydrochloric acid or citric acid and is commercially available. Thus corrosion inhibitors are usable which are used for pickling boiler tubes and plant piping systems with acids.

Hydrochloric acid and citric acid are effective for dissolving the ash in coal, especially iron compounds therein, while the fluoride is effective for dissolving siliceous compounds. However, these acids and fluoride produce a synergistic effect, such that the greatest deashing effect can be achieved by a solution containing the acid and fluoride. For deashing, acidic ammonium fluoride is the most effective of the fluorides. In addition to the strong deashing activity, this compound is decomposable by the subsequent waste water treatment and therefore will not add to the amount of sludge unlike sodium salts and potassium salts.

The deashing container 2 is divided by a partition wall 4 into a first chamber 2A and a second chamber 2B. The density of coal particles charged into the first chamber 2A of the container 2 is usually about 1.2 to about 1.5 g/cm$^3$, so that the coal particles descend toward the bottom of the container 2. Some kind of coal will not be readily wettable with water or solution, in which case a suitable surfactant is added to the deashing solution. The coal particles in the first chamber 2A are then forced upward as indicated by arrows in the drawing, by the deashing solution which is supplied at a suitable flow rate from the bottom inlet 16 of the chamber 2A, whereby the particles are fluidized and agitated. The particulate coal is then sent over the partition 4 into the second chamber 2B of the deashing container 2.

The coal per se has a density of about 1.2 to about 1.5 g/cm$^3$ as mentioned above, while the ash in the coal has a density of 2.0 to 5.0 g/cm$^3$, so that as the ash is dissolved out from the crude coal within the container 2, the density of the coal particles becomes closer to that of the coal per se. Consequently the density of coal particles deashed to a greater extent becomes smaller than that of coal particles not deashed. The former particles therefore collect in the upper portion of the first chamber 2A of the container 2 and flow over the partition wall 4 into the second chamber 2B in a gradually increasing ratio. The particulate coal is fluidized and agitated also in the second chamber 2B in the same manner as in the first chamber 2A. Since the ash dissolves usually at a low velocity, the coal must remain in the container for a sufficient period of time. Although the container 2 has two chambers 2A and 2B in the case of the present embodiment, two or more deashing containers 2 are usable.

The portion of coal which has been fully deashed in the container 2 by the dissolving of the ash then flows out from a coal outlet 5 along with the deashing solution and is led into a dewatering unit 6, in which it is separated from the solution. A centrifugal separator or filter is usable as the dewatering unit 6. A major portion of the solution is returned to a tank 11 for preparing the deashing solution, while the remaining portion of the solution is drawn off and introduced into a waste water treating unit 10, in which Si, Al, Fe and like metal ions dissolving in the solution are removed as a sludge. The solution thus treated is returned to the tank 11 for use in circulation.

The coal dewatered by the unit 6 is led into a washing tank 7 to remove hydrochloric acid or citric acid and fluoride. Washing water is circulated by a pump 8 to remove the chemical solution from the coal within the washing tank 7. A required number of washing tanks 7 may be used. When fully washed, the coal is run off from the washing tank 7 and introduced into a dewatering unit 9. The amount of water for replenishing the tank 7 corresponds to the amount of sludge plus the amount of water drawn off as entrained in the flow of the deashed coal. A conventional technique is used for the washing step.

The dewatered coal is dried when so desired and delivered as a product. The water separated off by the dewatering unit 9 is returned to the tank 11 for preparing the deashing solution. This tank 11 serves also as a decanter and has a partition plate 12 and an outlet 13 for discharging a sediment. The deashing agents are supplied to the tank 11 to maintain the solution at the specified concentrations. The deashing solution prepared is sent forward by a pump 14 and supplied to the container 2 through the inlets 16 at a rate regulated by regulating valves 15. Since the ash dissolving velocity increases with the rise of the treating temperature, it is preferable to heat the solution and maintain the container 2 at an elevated temperature to achieve a higher deashing efficiency.

Figure 10:
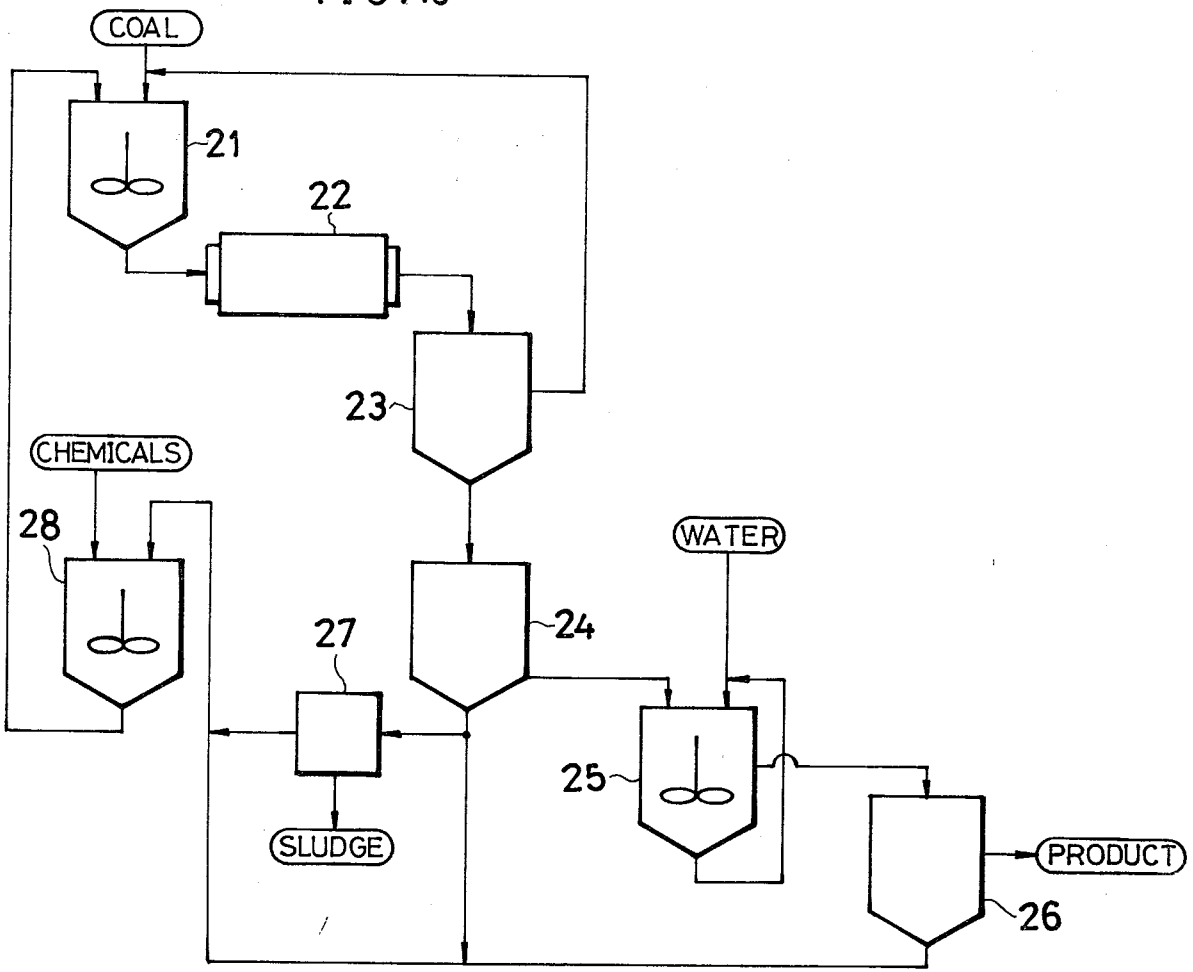
FIG. 10 is a flow chart showing another apparatus of the invention for chemically removing ash from coal.

Next, with reference to FIG. 10, the crude coal to be pulverized is charged into a mixer 21, in which the coal is mixed with an aqueous deashing solution in a specified ratio. The mixture of coal and solution is then introduced into a wet pulverizer 22. The type of the pulverizer 22 is not particularly limited; any wet pulverizer is usable, such as ball mill, tube mill, rod mill or attrition mill. In the pulverizer 22, the crude coal is pulverized and, at the same time, the pulverized coal is brought into contact with the deashing solution.

The aqueous deashing solution is prepared by admixing a fluoride with an aqueous solution of hydrochloric acid or citric acid containing a corrosion inhibitor. As already described, the corrosion inhibitor protects the apparatus and the piping from the corrosive solution of hydrochloric acid or citric acid.

The ash components of coal include those present in the coal as inclusions and those present in the structure of the coal. The former components are incorporated into the coal during the formation of coal and include soil, stone, etc. They appear on the surfaces of coal particles when the coal is pulverized by the wet pulverizer 22, are therefore brought into contact with the deashing solution very efficiently and can be dissolved rapidly. The ash components present in the structure of coal are incorporated thereinto during the growth of the original plant and are very difficult to remove.

The deashing solution in the form of an aqueous solution of hydrochloric acid or citric acid containing a fluoride effectively penetrates into the ash and loosens the bond between the coal and the ash, rendering the coal itself easy to break and generally producing the favorable result of assuring an improved pulverization efficiency. While the dissolving of the ash is influenced by the efficiency of contact between the ash and the chemical solution, the operation within the wet pulverizer 22 has ideal conditions in view of the contact efficiency.

The slurry drawn off from the wet pulverizer 22 is led into a classifier 23. The type of the classifier 23 is not particularly limited; a rake classifier, for example, is usable. The coarse particles separated off by the classifier 23 are charged into the mixer 21 again. The portion of coal pulverized to specified sizes and the solution are led into a dewatering unit 24, in which the coal is separated from the solution. A centrifugal separator or filter is usable as the dewatering unit 24. A major portion of the solution is returned to a tank 28 for preparing the deashing solution, while the remaining portion of the solution is drawn off and introduced into a waste water treating unit 27, in which Si, Al, Fe and like metal ions dissolving in the solution are removed as a sludge. The solution thus treated is returned to the tank 28 for use in circulation.

The coal dewatered by the unit 24 is introduced into a washing tank 25 to remove hydrochloric acid or citric acid and fluoride therefrom. The chemical solution is removed from the coal within the washing tank 25 with washing water used in circulation. A plurality of washing tanks 25 are used as desired. When thoroughly washed, the coal is run off from the washing tank 25 and introduced into a dewatering unit 26. The amount of water for replenishing the tank 25 corresponds to the amount of sludge plus the amount of water drawn off as entrained in the flow of the product. A conventional technique is used for the washing step.

The dewatered coal is dried when so desired and delivered as a product. The water separated off by the dewatering tank 26 is returned to the tank 28 for preparing the deashing solution. The tank 28 serves also as a decanter. The tank 28 is replenished with the deashing agents to maintain the solution at the specified concentrations. The deashing solution prepared is supplied to the mixer 21 again.

The present invention may be embodied differently without departing from the spirit and basic features of the invention. Accordingly the embodiments herein disclosed are given for illustrative purposes only and are in no way limitative. It is to be understood that the scope of the invention is defined by the appended claims rather than by the specification and that various alterations and modifications within the definition and scope of the claims are included in the claims.

What is claimed is:

1. A process for chemically removing ash from coal comprising the steps of immersing finely divided ash-containing coal in an aqueous deashing solution containing an acid selected from the group consisting of hydrochloric acid and citric acid, and acidic ammonium fluoride to cause the ash to react with the acid and the acidic ammonium fluoride in the aqueous solution, and separating deashed fine coal particles from the aqueous solution.

2. A process as defined in claim 1 wherein the deashing solution contains 1.0 to 12.0% by weight of hydrochloric acid and 1.25 to 10.0% by weight of acidic ammonium fluoride.

3. A process as defined in claim 1 wherein the deashing solution contains 1.0 to 10.0% by weight of citric acid and 1.0 to 10.0% by weight of acidic ammonium fluoride.

* * * * *